US009915214B2

(12) United States Patent
Crenne

(10) Patent No.: US 9,915,214 B2
(45) Date of Patent: Mar. 13, 2018

(54) METHOD FOR CONTROLLING A SPEED SURGE OF AN INTERNAL COMBUSTION ENGINE OF A MOVING VEHICLE DURING A GEARBOX RATIO CHANGE

(71) Applicants: CONTINENTAL AUTOMOTIVE FRANCE, Toulouse (FR); CONTINENTAL AUTOMOTIVE GmbH, Hannover (DE)

(72) Inventor: Dominique Crenne, Toulouse (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 301 days.

(21) Appl. No.: 14/790,031

(22) Filed: Jul. 2, 2015

(65) Prior Publication Data

US 2016/0010577 A1 Jan. 14, 2016

(30) Foreign Application Priority Data

Jul. 8, 2014 (FR) ..... 14 56560

(51) Int. Cl.
*F02D 41/02* (2006.01)
*F02D 41/04* (2006.01)
(Continued)

(52) U.S. Cl.
CPC ..... *F02D 41/023* (2013.01); *F02D 41/045* (2013.01); *F02D 41/12* (2013.01);
(Continued)

(58) Field of Classification Search
CPC ..... F02D 41/023; F02D 41/123
See application file for complete search history.

(56) References Cited

U.S. PATENT DOCUMENTS 5,390,637 A 2/1995 Yoshioka et al.
6,223,592 B1 5/2001 Genise
(Continued)

FOREIGN PATENT DOCUMENTS

CN 1253892 A 5/2000
CN 101324270 A 12/2008
(Continued)

OTHER PUBLICATIONS

French Search Report, dated Mar. 4, 2015, from corresponding PCT application.

*Primary Examiner* — Sherry L Estremsky
(74) *Attorney, Agent, or Firm* — Young & Thompson

(57) ABSTRACT

Method for controlling speed surge of an internal combustion engine of a moving vehicle during a ratio change of a manual gearbox, the vehicle including an engine control unit with a transient progressive torque reduction phase activated when the driver requests zero torque or when the foot is raised, the engine control unit: detects the raised foot and activates the transient progressive torque reduction phase; records engine speed and determines the gearbox ratio engaged when the foot is raised; determines, a maximum permissible engine speed (Nmax) which is greater than the recorded speed (Nlvp) of the raised foot, in accordance with the engine speed recorded and the engaged gearbox ratio; monitors the current speed (Nc) so that if Nc>Nmax, a stop is initiated with immediate effect of the transient progressive torque reduction phase, an if Nc≤Nmax, the transient progressive torque reduction phase is maintained.

12 Claims, 3 Drawing Sheets

(51) Int. Cl.
*F02D 41/12* (2006.01)
*F02D 11/10* (2006.01)

(52) U.S. Cl.
CPC ..... *F02D 41/123* (2013.01); *F02D 11/105* (2013.01); *F02D 41/0205* (2013.01); *F02D 41/0225* (2013.01); *F02D 2200/101* (2013.01); *F02D 2200/602* (2013.01)

(56) References Cited

U.S. PATENT DOCUMENTS

| | | | | |
|---|---|---|---|---|
| 6,305,343 | B1 | 10/2001 | Sato et al. | |
| 6,773,372 | B2 * | 8/2004 | Matsubara | B60W 10/06 477/78 |
| 7,024,298 | B2 * | 4/2006 | Oohori | B60W 10/06 180/197 |
| 7,300,381 | B2 * | 11/2007 | Badillo | B60W 10/02 477/101 |
| 9,188,045 | B2 * | 11/2015 | Banker | F01N 11/007 |
| 2002/0115530 | A1 | 8/2002 | Skinner et al. | |
| 2004/0014565 | A1 | 1/2004 | Oshima et al. | |
| 2008/0312035 | A1 | 12/2008 | Murayama et al. | |
| 2012/0142488 | A1 | 6/2012 | Kin et al. | |
| 2013/0172148 | A1 | 7/2013 | Wiencek et al. | |
| 2013/0296117 | A1 | 11/2013 | Shelton et al. | |
| 2016/0146121 | A1 * | 5/2016 | Carlson | F02D 17/02 60/276 |
| 2016/0363063 | A1 * | 12/2016 | Pochner | F02D 41/0002 |

FOREIGN PATENT DOCUMENTS

| | | | |
|---|---|---|---|
| DE | 102009027502 | A1 | 2/2010 |
| DE | 102010042474 | A1 | 4/2011 |
| DE | 102011006703 | A1 | 6/2012 |
| DE | 102011016643 | A1 | 10/2012 |
| DE | 102011103692 | A1 | 12/2012 |
| GB | 2386932 | A | 10/2003 |
| JP | 2007023921 | * | 2/2007 |
| JP | 2011085067 | * | 4/2011 |
| KR | 20030029365 | A | 4/2003 |
| WO | 2012031836 | A1 | 3/2012 |

* cited by examiner

APPROVED: /S.L.E/

METHOD FOR CONTROLLING A SPEED SURGE OF AN INTERNAL COMBUSTION ENGINE OF A MOVING VEHICLE DURING A GEARBOX RATIO CHANGE

FIELD OF THE INVENTION

The present invention relates to a method for controlling a speed surge of an internal combustion engine of a moving vehicle during a ratio change of a manual gearbox which is placed in the chain for transmission of the power from a crankshaft of the internal combustion engine to the drive wheels of the vehicle, the vehicle comprising an engine control unit, means for determining the speed of the crankshaft, an accelerator which allows the driver to adjust his demand in terms of engine torque, means for determining the position of the accelerator, the engine control unit being provided with a transient progressive torque reduction phase which is activated when the driver requests zero torque, or when the foot is raised, or the accelerator is completely raised, as defined below.

BACKGROUND OF THE INVENTION

During a ratio change of the gearbox, in the general case of a conventional motor vehicle, the driver first lifts his foot from the accelerator pedal which, as soon as the accelerator has reached the rest or zero torque demand position thereof, corresponding to complete raising of the pedal, brings about the immediate initiation of a transient progressive torque reduction phase comprising the closure of the air inlet valve(s) in the cylinders of the engine. The raising of the foot from the accelerator, referred to below as "raising the foot", or "complete raising of the foot" detected by the engine control unit as a result of a position sensor which is associated with the accelerator pedal, thus represents for the pedal a zero torque request on the part of the driver.

The transient progressive torque reduction phase strategy involves in particular not immediately cutting off the injection at all the cylinders at the same time and thus prevents any excessively abrupt reaction of the vehicle for the passengers thereof, of the jerked slowing action type. In this manner, such a strategy involves in known manner, extending over a period of time which may be up to several hundreds of milliseconds, approximately from the raising of the foot:

- a delay in injection cut-off, this delay being able to be in the form, for example, of a sequential cut-off of the injection of all the cylinders in a predetermined order,
- a predetermined control of the progress to ignition,
- a predetermined control of the reserve of combustive in the inlet conduit, in accordance with the transient progressive torque reduction control mode which has been implemented in the engine control unit.

The control of the torque in the progressive torque reduction phase may bring about a surge of the engine speed during a gearbox ratio change, between the disengaged state and the engaged state, from the disengagement of the engine until the end of the transient progressive torque reduction phase. Such a surge of speed is unpleasant for the driver who may be momentarily surprised by the reaction of the engine.

When the vehicle is provided with an engagement sensor which is capable of transmitting to the engine control unit information relating to the engagement state, that is to say, disengaged or engaged, a surge of speed during a gearbox ratio change may be prevented as a result of this sensor by coupling it to the position sensor of the accelerator pedal which provides the information concerning the torque requested by the driver. This is because, with such a clutch sensor, the engine control unit may immediately and without delay cut off the injection of fuel as soon as the information relating to a disengagement has been received. In this instance, the immediate cut-off of injection takes priority over the progressive cut-off strategy of the injection applied when the foot is raised, which is therefore not activated since it has no use, the engine being disengaged.

SUMMARY OF THE INVENTION

An object of the present invention is to provide an alternative anti-surge method for the engine speed during a gearbox ratio change for vehicles which have no such clutch sensor, for whatever reasons, whether it be, for example, economies of production cost, a desire for hardware simplicity, etcetera.

More specifically, in the application context as defined at the beginning of the document, the method according to the present invention is characterized in that it comprises the following steps:

- the engine control unit detects the foot being raised and activates the transient progressive torque reduction phase;
- the engine control unit records the engine speed and determines the gearbox ratio engaged when the foot is raised;
- the engine control unit then determines, in the raised foot state, a maximum permissible engine speed which is greater than the recorded engine speed at the raising of the foot, in accordance with:
  - the engine speed recorded, and
  - the engaged gearbox ratio;
- the engine control unit then monitors the current engine speed after the time at which the foot is raised, so that:
  - if the current engine speed exceeds the maximum permissible engine speed, the engine control unit initiates a stop with immediate effect of the transient progressive torque reduction phase,
  - if the current engine speed remains less than or equal to the maximum permissible engine speed, the engine control unit maintains the transient progressive torque reduction phase activated when the foot is raised.

The invention has the advantage of being able to be implemented using simple software which will be implemented in the engine control unit. Furthermore, it is compatible with any transient progressive torque reduction strategy which is activated when the foot is raised and which remains active and which therefore does not impair the comfort of the vehicle for the passengers. The Applicant has found that the surge of speed becomes higher as the ratio engaged before the ratio is changed becomes lower, for example, for 1st and 2nd gears. The engaged ratio is therefore a significant element for determining the permissible speed surge threshold when a gear is changed. The invention defined above further allows a simple raising of the foot which is not followed by disengagement to be distinguished from a raising of the foot followed by disengagement with a gearbox ratio change. This distinction is based on the determination of the maximum permissible speed, or engine speed threshold, from which a stoppage with immediate effect of the transient progressive torque reduction phase is activated. The method according to the invention therefore accepts a controlled and limited speed surge as a result of a determination of the maximum permissible speed. The determination of this maximum permissible speed which is made dependent on the engine speed and the gear ratio engaged when the foot is raised, allows a fine determination of the permissible speed surge limit as distinct from a simple raising of the foot without any ratio change, and consequently makes it completely acceptable for the driver to have the speed surge permitted by the method according to the invention which is reduced in comparison with a speed surge in the same context without an engagement sensor dedicated to determining the disengaged or engaged state of the engine. The gearbox ratio engaged can be calculated by the engine control unit from the ratio "vehicle speed/engine speed", these two items of information being known and available in the engine control unit, this ratio providing an image of the gearbox ratio engaged when the foot is raised, therefore before the gearbox ratio is changed.

According to an advantageous feature, the engine control unit detects the raising of the foot using a position sensor of the accelerator pedal of the vehicle, in the zero engine torque demand position.

According to an advantageous feature, the stoppage with immediate effect of the transient progressive torque reduction phase involves initiating an immediate cut-off of the injection at all the cylinders of the engine.

According to an advantageous feature, the maximum permissible engine speed is determined for a predetermined validity period which follows the raising of the foot.

According to an advantageous feature, the predetermined validity period extends from the raising of the foot to the end of the first engine speed oscillation in the event of the foot being raised without any change of ratio.

This end of the first engine speed oscillation which follows a raising of the foot can be determined, for example, from a calibration which allows the duration of the first oscillation to be obtained in accordance with the engine speed and the engaged gearbox ratio.

According to an advantageous feature, the maximum permissible engine speed is determined so that the stoppage with immediate effect of the transient progressive torque reduction phase is not activated whilst the increase of the engine speed leaves the current engine speed in a range of engine speeds which is representative of normal speed fluctuations after a foot has been raised, in the engaged gearbox ratio, and taking into account the transient progressive torque reduction phase.

When a foot is raised, at some reduced gearbox ratios, for example, a ratio of 1st and 2nd gears, there may be fluctuations of the engine speed to a greater or lesser extent before the engine speed is lowered regularly in accordance with the progressive injection cut-off strategy which allows jerky actions to be prevented and which is implemented in the engine control unit, as described above. The feature above allows the distinction to be improved in order to prevent an untimely activation of the anti-speed-surge function according to the invention during a simple raising of the foot which is not followed by disengagement since this would result in activating an immediate cut-off of the injection, bringing about an unacceptable abrupt slowing of the vehicle. This is because there is good reason to absolutely prevent an activation of the engine speed anti-surge function whilst the strategy of progressively cutting-off fuel injection in order to prevent jerky actions is activated in an appropriate manner.

The invention also relates to a device for controlling a speed surge of an internal combustion engine of a moving vehicle, during a change of ratio of a manual gearbox which is placed in the chain for transmission of the power from a crankshaft of the internal combustion engine to the drive wheels of the vehicle, the vehicle comprising an engine control unit, means for determining the speed of the crankshaft, means for calculating the gearbox ratio engaged, an accelerator which allows the driver to adjust his engine torque demand, means for determining the position of the accelerator, the engine control unit being provided with a transient progressive torque reduction phase which is activated when the driver requests zero torque, or when the foot is raised, characterized in that it comprises means for implementing a method according to the invention.

BRIEF DESCRIPTION OF THE DRAWINGS

Other features and advantages will be appreciated from a reading of the following description of an embodiment of a method according to the invention, accompanied by the appended drawings, which example is given by way of non-limiting illustration. In the drawings.

DETAILED DESCRIPTION OF THE INVENTION

Figure 1:
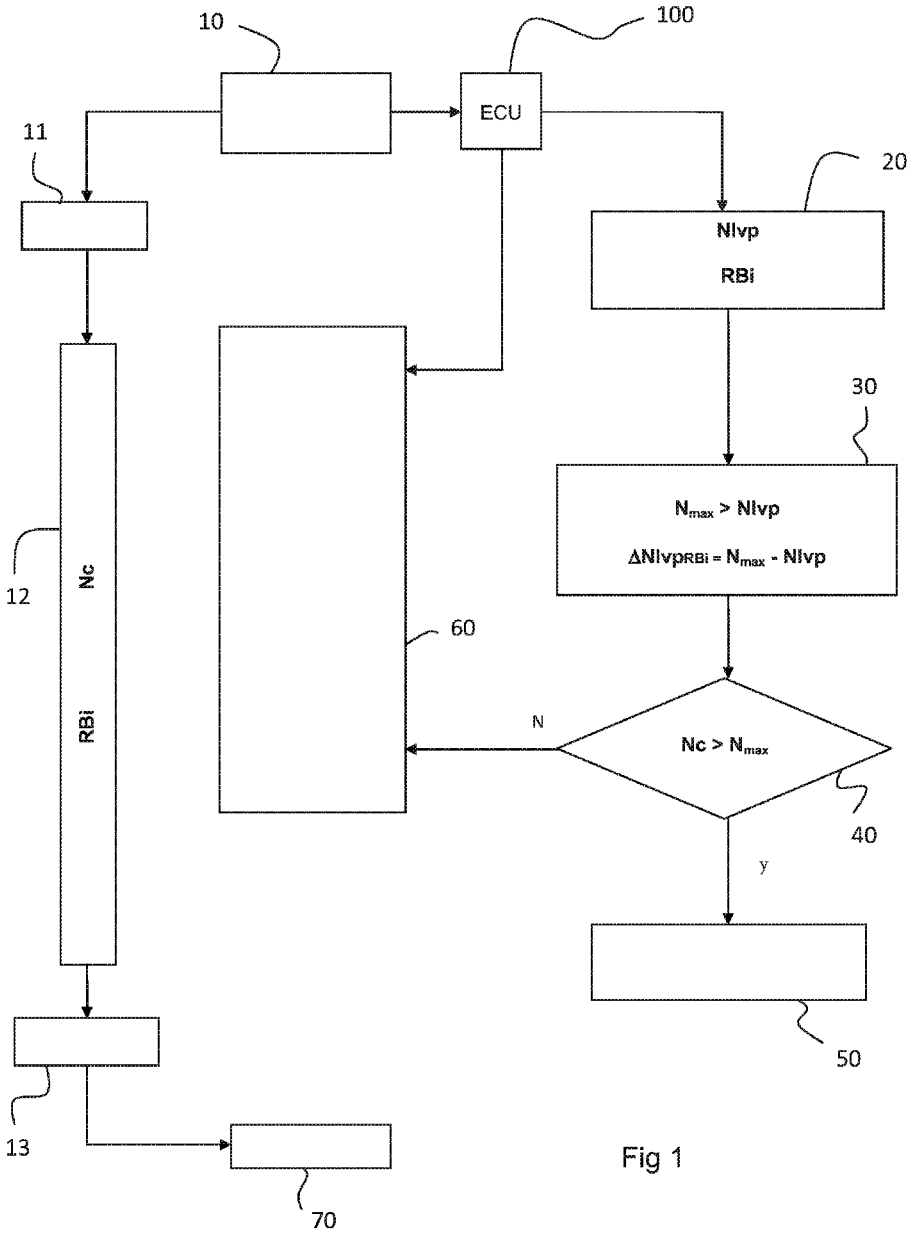
FIG. 1 shows a flow chart of an example of a method according to the invention for controlling a speed surge of an internal combustion engine of a moving vehicle, during a ratio change of a gearbox ratio.

The flow chart according to FIG. 1 illustrates an example of a method for controlling a speed surge of an internal combustion engine of a moving vehicle during a change of ratio of a manual gearbox which is placed in the chain for transmission of the power from a crankshaft of the internal combustion engine to the drive wheels of the vehicle, the vehicle comprising an engine control unit 100 or ECU, means for determining the speed of the crankshaft (not illustrated), an accelerator which allows the driver to adjust his engine torque demand (not illustrated), means for determining the position of the accelerator (not illustrated). The vehicle is not provided with a clutch sensor which is dedicated to the detection of the disengaged or engaged state of the engine.

The engine control unit 100 is provided with a transient progressive torque reduction phase strategy 60 which is activated in particular during a zero torque request by the driver, or when a foot is raised, that is to say, corresponding to a rest position of the accelerator brought about by a complete release thereof on the part of the driver of the vehicle. Such a transient progressive torque reduction phase strategy 60 may take a number of forms, as explained above, for example, sequential interruption of the engine injectors in a predetermined order and/or a delay of the injection cut-off, and/or a transient modification of the progress to ignition, and comprises the closure of the air inlet valve. These strategies are known to the person skilled in the art and will not be described in greater detail here.

According to the invention and in accordance with FIG. 1, the method comprises the following steps:

Step 10: the engine control unit 100 detects that a foot has been raised, for example, using a position sensor of the accelerator pedal in the raised foot position, and activates the transient progressive torque reduction phase 60 which is implemented in the engine control unit 100;

Step 20: when the foot is raised, the engine control unit 100 carries out the following actions:

it records the engine speed Nlvp corresponding to the time at which the foot is raised, it determines the gearbox ratio RBi engaged at this time;

Step 30: the engine control unit 100 then determines, in the state in which a foot is raised, a maximum permissible engine speed $N_{max}$ which is greater than the engine speed Nlvp recorded when the foot is raised, in accordance with:

the engine speed Nlvp recorded, and the gearbox ratio RBi engaged,

Step 40: the engine control unit 100 then monitors the current engine speed Nc after the time at which the foot is raised, so that:

Step 50: if the current engine speed Nc exceeds the maximum permissible engine speed $N_{max}$, the engine control unit 100 initiates a stoppage with immediate effect of the transient progressive torque reduction phase 60, for example, using an immediate cut-off of the injection at all the cylinders of the engine, and Step 60: if the engine speed Nc remains less than or equal to the maximum permissible engine speed $N_{max}$, the engine control unit maintains the transient progressive torque reduction phase activated when the foot is raised.

According to a normal sequence of the method according to the invention and according to the example illustrated with the flow chart of FIG. 1, the driver disengages the engine in step 11, after the raising of the foot has been carried out in step 10. The driver engages the engine again, for example, in step 13 in FIG. 1, after step 12 of changing the gearbox ratio RBi, as illustrated.

The driver accelerates at step 70, in principle at the same time or after the engagement step 13.

It is not necessary for the transient progressive torque reduction phase 60 to be complete for the driver to proceed to step 13 of engaging the engine, this transient phase 60 being in any case deactivated when the driver presses the accelerator again.

Figure 4:
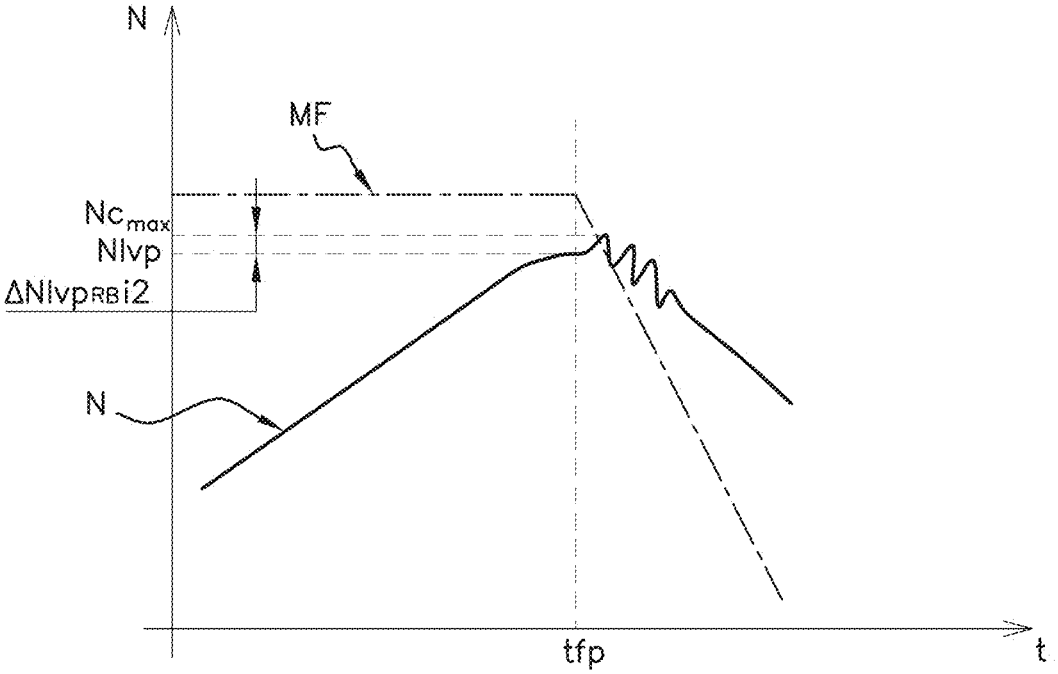
FIG. 4 shows a graph of the development of the engine speed when the foot is raised without disengagement.

Preferably, at step 30, the maximum permissible engine speed $N_{max}$ is determined for a predetermined validity period which follows the foot being raised. This predetermined validity period may extend from the foot being raised in step 10 in FIG. 1 to the end of the first engine speed oscillation in the case of a foot being raised without a ratio change as illustrated in FIG. 4. The predetermined validity period is, for example, obtained by means of calibration in the form of a tabulation or mapping in accordance with the engine speed and the gearbox ratio engaged.

The maximum permissible engine speed $N_{max}$ is equal to the engine speed Nlvp recorded when the foot is raised, with the addition of a speed variation ΔNlvp, thus being: $N_{max}$=Nlvp+ΔNlvp. The engine speed variation ΔNlvp is determined in accordance with the ratio RBi of the ratio engaged when the foot is raised and the speed Nlvp, that is, referred to as $\Delta Nlvp_{RBi}$ as may be seen in the flowchart of FIG. 1.

The variation $\Delta Nlvp_{RBi}$ is preferably determined so that the stoppage with immediate effect of the transient progressive torque reduction phase 60 at step 50, for example, by immediate cut-off of the injection at all the cylinders of the engine, is not activated whilst the increase of the engine speed leaves the current engine speed Nc in a range of engine speeds which is representative of normal speed fluctuations after the foot has been raised, in the gearbox ratio RBi engaged, and taking into account the implemented strategy of the transient progressive torque reduction phase 60, that is to say, as long as the current engine speed Nc has not reached a threshold speed which is representative of a speed surge during a gearbox ratio change.

Table I below shows an example of a mapping obtained, for example, by means of calibration, of the variation of the permissible engine speed $\Delta Nlvp_{RBi}$ in revolutions per minute (rpm) which may be applied to the effect described in the preceding paragraph, for an engine speed range Nlvp when the foot is raised of from 1000 to 6000 rpm, and for a manual six speed gearbox RBi:

TABLE I

| | Nlvp | | | | | |
|---|---|---|---|---|---|---|
| RBi | 1000 | 2000 | 3000 | 4000 | 5000 | 6000 |
| 1 | 200 | 200 | 150 | 100 | 50 | 50 |
| 2 | 200 | 200 | 150 | 100 | 50 | 50 |
| 3 | 150 | 150 | 150 | 100 | 50 | 50 |
| 4 | 100 | 100 | 100 | 100 | 50 | 50 |
| 5 | 50 | 50 | 50 | 50 | 50 | 50 |
| 6 | 50 | 50 | 50 | 50 | 50 | 50 |

Figure 2:
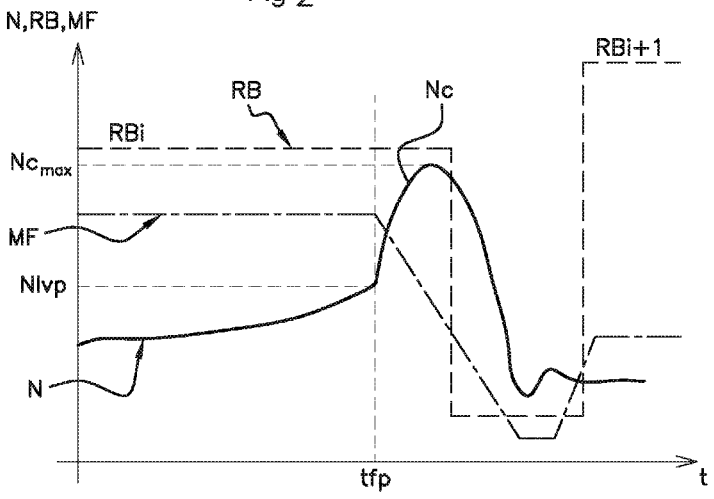
Prior Art Fig 2
FIG. 2 shows a graph which shows a development example of several engine parameters during a change of ratio, according to the prior art.

FIG. 2 indicates a plurality of lines which correspond to the development of several engine parameters during a gearbox ratio change, with a speed surge, according to the prior art. The line designated N represents the engine speed, the line designated RB the gearbox ratio change, and the line designated MF the quantity of fuel injected. The vehicle does not comprise any engagement sensor which is dedicated to the information concerning the disengaged or engaged state of the clutch. On the abscissa there appears a timescale t, and, on the ordinate, a plurality of merged scales which correspond to the parameters represented. The point tfp on the abscissa in FIG. 2 represents the time at which the foot is raised. The engaged gearbox ratio when the foot is raised is RBi and the change ratio is RBi+1. It is possible to see the progressive cut-off of the injection after the time tfp illustrating in the example via an inclination the activated strategy of transient progressive torque reduction phase. The engine speed N shows a significant current speed surge Nc during the change of gearbox ratio which reaches the value $Nc_{max}$ which is very clearly above the speed value Nlvp at the time tfp at which the foot is raised. The extent of the surge illustrated is disruptive with respect to the driving comfort.

Figure 3:
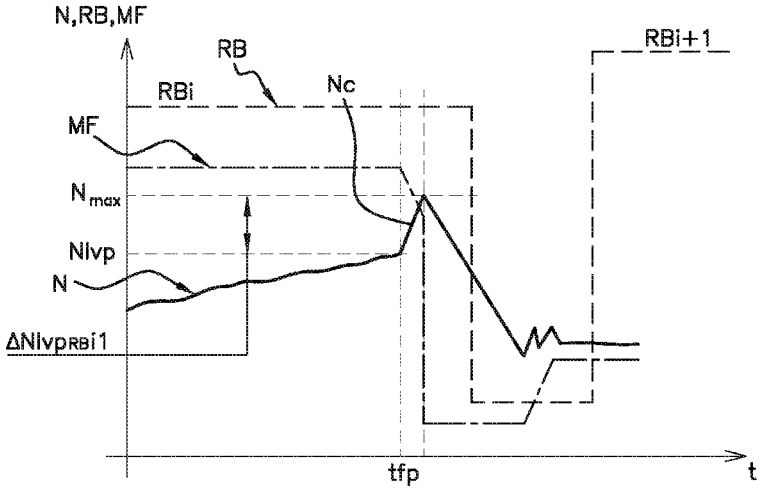
FIG. 3 shows a graph illustrating a similar development example of several engine parameters during a ratio change, with a method according to the invention.

FIG. 3 indicates a plurality of lines which correspond to the development of the same engine parameters during a gearbox ratio change, with a speed surge, by applying a method according to the invention as described, for example, above. The same line reference numerals indicate the same engine parameters, respectively. The vehicle does not comprise a clutch sensor. The point tfp on the abscissa in FIG. 3 illustrates the time at which the foot is raised. The gearbox ratio engaged when the foot is raised is RBi and the change ratio is RBi+1. It is possible to see the progressive cut-off of the injection after the time tfp illustrating via an inclination portion the activated strategy of the transient progressive torque reduction phase. The current engine speed Nc shows the beginning of a controlled speed surge during the change of gearbox ratio immediately after the time tfp, which reaches the controlled value $N_{max}$ determined by the engine control unit as indicated above. The extent of the surge illustrated is limited corresponding to the variation of the engine speed N which is equal to the value $\Delta Nlvp_{RBi}1=N_{max}-Nlvp$ as illustrated, which is non-disruptive for the driving comfort. When the engine speed reaches $N_{max}$, the activation with immediate effect of the injection cut-off can be seen from the line MF via a portion of vertical straight line which simultaneously brings about a reduction of the current engine speed Nc by clearly stopping the speed surge.

FIG. 4 shows two lines which correspond to the development of two engine parameters, respectively, during a simple raising of the foot with no disengagement, with fluctuations of the engine speed before a regular reduction thereof initially following the raising of the foot. The line designated N represents the engine speed, and the line designated MF the quantity of fuel injected. On the abscissa there appears a timescale t and on the ordinate two merged scales which correspond to the two parameters illustrated. The point tfp on the abscissa in FIG. 4 represents the time at which the foot is raised. It is possible to see the activation of a transient progressive torque reduction phase strategy after the time tfp illustrated by a descending inclination of the engine speed. The engine speed N shows a slight speed surge as a result of a fluctuation thereof before a reduction. This speed fluctuation may be a result of the transmission. The extent of the surge in this instance is low and acceptable since the engine is in engagement with the drive wheels and must be distinguished from a speed surge during a change of gearbox ratio, as indicated above. As illustrated in FIG. 4, the small extent of the surge illustrated corresponds to the variation of the engine speed N which is equal to the value $\Delta Nlvp_{RBi}2=Nc_{max}-Nlvp$.

An example of a device for controlling a speed surge of an internal combustion engine of a moving vehicle comprises an engine control unit 100 in which there is implemented a piece of software which allows a method according to the invention to be implemented, for example, as described above, and, in known manner, means for determining the speed of the crankshaft which comprise a rotation speed sensor of the crankshaft, means for calculating the engaged gearbox ratio as indicated above from the ratio "vehicle speed/engine speed", an accelerator which allows the driver to adjust his engine torque demand, means for determining the position of the accelerator, the engine control unit 100 being further provided in known manner with a transient progressive torque reduction phase 60 which is activated in particular when the driver requests zero torque or raises his foot.

The invention claimed is:

1. A method for controlling a speed surge of an internal combustion engine of a moving vehicle during a ratio change of a manual gearbox which is placed in the chain for transmission of the power from a crankshaft of the internal combustion engine to the drive wheels of the vehicle, the vehicle comprising an engine control unit (100), crankshaft rotation speed sensor, an accelerator which allows the driver to adjust his demand in terms of engine torque, accelerator pedal position sensor, the engine control unit being provided with a transient progressive torque reduction phase (60) which is activated when the driver requests zero torque or when the foot is raised, wherein the method comprises the following steps:

the engine control unit detects (10) the foot being raised and activates the transient progressive torque reduction phase (60);

the engine control unit records (20) the engine speed (Nlvp) and determines the gearbox ratio (RBi) engaged when the foot is raised;

the engine control unit then determines (30), in the raised foot state, a maximum permissible engine speed ($N_{max}$) which is greater than the recorded engine speed (Nlvp) at the raising of the foot, in accordance with:

the engine speed recorded, and the engaged gearbox ratio;

the engine control unit then monitors (40) the current engine speed (Nc) after the time at which the foot is raised, so that:

if the current engine speed (Nc) exceeds the maximum permissible engine speed ($N_{max}$), the engine control unit initiates a stop with immediate effect of the transient progressive torque reduction phase (60), if the current engine speed (Nc) remains less than or equal to the maximum permissible engine speed ($N_{max}$), the engine control unit maintains the transient progressive torque reduction phase (60) activated when the foot is raised.

2. The method as claimed in claim 1, wherein the engine control unit (100) detects the raising of the foot using the accelerator pedal position sensor in the zero engine torque demand position.

3. The method as claimed in claim 2, wherein, in the monitoring step (40), the stoppage with immediate effect of the transient progressive torque reduction phase (60) involves initiating an immediate cut-off of the injection at all the cylinders of the engine.

4. The method as claimed in claim 2, wherein, in the determining step (30), the maximum permissible engine speed ($N_{max}$) is determined for a predetermined validity period which follows the raising of the foot.

5. The method as claimed in claim 2, wherein the maximum permissible engine speed ($N_{max}$) is determined so that the stoppage with immediate effect of the transient progressive torque reduction phase is not activated whilst the increase of the engine speed leaves the current engine speed (Nc) in a range of engine speeds which is representative of normal speed fluctuations after a foot has been raised, in the engaged gearbox ratio (RBi), and taking into account the transient progressive torque reduction phase (60).

6. The method as claimed in claim 1, wherein, in the monitoring step (40), the stoppage with immediate effect of the transient progressive torque reduction phase (60) involves initiating an immediate cut-off of the injection at all the cylinders of the engine.

7. The method as claimed in claim 6, wherein, in the determining step (30), the maximum permissible engine speed ($N_{max}$) is determined for a predetermined validity period which follows the raising of the foot.

8. The method as claimed in claim 6, wherein the maximum permissible engine speed ($N_{max}$) is determined so that the stoppage with immediate effect of the transient progressive torque reduction phase is not activated whilst the increase of the engine speed leaves the current engine speed (Nc) in a range of engine speeds which is representative of normal speed fluctuations after a foot has been raised, in the engaged gearbox ratio (RBi), and taking into account the transient progressive torque reduction phase (60).

9. The method as claimed in claim 1, wherein, in the determining step (30), the maximum permissible engine speed ($N_{max}$) is determined for a predetermined validity period which follows the raising of the foot.

10. The method as claimed in claim 9, wherein the predetermined validity period extends from the raising of the foot to the end of the first engine speed oscillation in the event of the foot being raised without any change of ratio.

11. The method as claimed in claim 1, wherein the maximum permissible engine speed ($N_{max}$) is determined so that the stoppage with immediate effect of the transient progressive torque reduction phase is not activated whilst the increase of the engine speed leaves the current engine speed (Nc) in a range of engine speeds which is representative of normal speed fluctuations after a foot has been raised, in the engaged gearbox ratio (RBi), and taking into account the transient progressive torque reduction phase (60).

12. A device for controlling a speed surge of an internal combustion engine of a moving vehicle, during a change of ratio of a manual gearbox which is placed in the chain for transmission of the power from a crankshaft of the internal combustion engine to the drive wheels of the vehicle, the vehicle comprising an engine control unit (100), crankshaft rotation speed sensor, means for calculating the gearbox ratio engaged, an accelerator which allows the driver to adjust his engine torque demand, accelerator pedal position sensor, the engine control unit being provided with a transient progressive torque reduction phase (60) which is activated when the driver requests zero torque or when the foot is raised, wherein the device comprises the engine control unit (100), means for implementing a method according to claim 1.

* * * * *